US006609559B2

(12) United States Patent
Jackson

(10) Patent No.: US 6,609,559 B2
(45) Date of Patent: Aug. 26, 2003

(54) GRID FOR INTERCEPTING SOLID ELEMENTS CIRCULATED IN A HEAT EXCHANGER TO CLEAN IT, AND A CONTROL INSTALLATION FOR SUCH ELEMENTS INCLUDING SUCH A GRID

(75) Inventor: Philip Jackson, Paris (FR)

(73) Assignee: Beaudrey CS, Courbevoie (FR)

( * ) Notice: Subject to any disclaimer, the term of this patent is extended or adjusted under 35 U.S.C. 154(b) by 0 days.

(21) Appl. No.: 09/897,442

(22) Filed: Jul. 3, 2001

(65) Prior Publication Data

US 2002/0017379 A1 Feb. 14, 2002

(30) Foreign Application Priority Data

Jul. 3, 2000 (FR) ..... 00 08625

(51) Int. Cl.[7] ..... B07B 1/49; F28G 13/00
(52) U.S. Cl. ..... 165/95; 209/399; 209/400
(58) Field of Search ..... 165/95; 15/3.51; 209/399, 400

(56) References Cited

U.S. PATENT DOCUMENTS

| | | | | |
|---|---|---|---|---|
| 1,795,348 A | | 3/1931 | Schmidt | |
| 3,882,931 A | | 5/1975 | Kumagai | |
| 4,265,742 A | * | 5/1981 | Bucker | 209/399 |
| 4,304,295 A | | 12/1981 | Otake | |
| 4,661,245 A | * | 4/1987 | Rutherford | 209/399 |
| 4,762,610 A | | 8/1988 | Freissle | |
| 4,814,076 A | | 3/1989 | Jackson | |
| 4,909,929 A | * | 3/1990 | Tabor | 209/400 |
| 4,960,510 A | * | 10/1990 | Wolff | |
| 5,086,833 A | * | 2/1992 | Ben-Dosa | 165/95 |
| 5,248,043 A | * | 9/1993 | Dorn | |
| 5,598,889 A | * | 2/1997 | Jackson | 165/95 |
| 6,267,246 B1 | * | 7/2001 | Russell et al. | 209/399 |
| 6,267,880 B1 | * | 7/2001 | Jackson | 210/160 |
| 6,283,303 B1 | * | 9/2001 | Lane | 209/405 |

FOREIGN PATENT DOCUMENTS

| | | |
|---|---|---|
| DE | 30 15 677 | 11/1980 |
| EP | 0 457 238 A1 | 11/1991 |
| FR | A-2 766 915 | 2/1999 |
| GB | 2 203 061 A | 10/1988 |

* cited by examiner

*Primary Examiner*—Henry Bennett
*Assistant Examiner*—Tho v Duong
(74) *Attorney, Agent, or Firm*—Young & Thompson

(57) ABSTRACT

A grid for intercepting solid elements circulated in a heat exchanger to clean it; the grid includes a frame (33) and molded grid members (36) assembled onto the frame (33); the frame (33) is made up of parallel sheet metal chevrons (34) disposed at a regular pitch and transverse cross members (35) and an articulation shaft (31) passing through and welded to the chevrons; the grid members are globally rectangular and extend successively between two plates (34). A control installation for solid cleaning elements, includes the above kind of grid.

10 Claims, 3 Drawing Sheets

GRID FOR INTERCEPTING SOLID ELEMENTS CIRCULATED IN A HEAT EXCHANGER TO CLEAN IT, AND A CONTROL INSTALLATION FOR SUCH ELEMENTS INCLUDING SUCH A GRID

The present invention relates generally to heat exchangers, for example tubular heat exchangers forming condensers, which are cleaned continuously by solid elements, in practice foam rubber balls, for example, systematically circulated in one of the flows concerned for this purpose.

The principle of such cleaning arrangements has been known for a very long time. See for example the documents U.S. Pat. No. 1,795,348 and DE-A-23 14 329.

When water taken from the natural environment, whether recycled or not, is passed through the tubes of exchangers, the tubes tend to become fouled. This is known in the art. The fouling takes the form of a biological surface film or deposits of fine particles or limescale, and usually a combination of these effects.

The tubes are cleaned by injecting solid cleaning elements into the upstream end of the exchanger, usually foam rubber balls whose density is substantially equal to that of the cooling water and whose diameter is very slightly greater than the inside diameter of the tubes to be cleaned.

The solid cleaning elements are captured in the outlet pipe of the exchanger by the interposition of a grid of bars, which is of elliptical form and which is inclined at an angle, for example, in the range from 20° to 30°; the intercepted elements are rolled along the grid by the flow of water and are collected at the downstream end of the grid.

To limit the length of the device two grids in a V arrangement are often used, with the point at the top or at the bottom, with the cleaning elements respectively collected from both sides or from the center.

The elements are extracted with a small proportion of the flow of water by a pump; more generally, the control system for the solid cleaning elements includes a collection lock so that they can be stopped, allowed to circulate or changed; to recycle the solid cleaning elements, the pump feeds them, and the water, to the upstream side of the exchanger.

The grids consist of a support frame which is generally articulated to enable the grids to be pivoted and periodically cleaned by contraflow.

The frame supports the grids, which consist of equally spaced bars with gaps of a few millimeters between them.

The cleaning elements are inherently deformable and require the grids to be of very high quality: a constant spacing between the bars and freedom from asperities, discontinuities and singular points, to prevent the elements from being stopped and accumulating, which would render them inoperative.

Also, the bars must be thin to reduce the head loss.

The flow of water in the pipework, usually at a relatively high speed, of the order of 1.5 to 3 m/s, tends to generate vibrations, with potential destruction of the equipment by metal fatigue.

The current method of constructing the grids consists of drilling holes in stainless steel bars at regular intervals and assembling them by means of rods passed through the holes, with tubular spacers between the bars; these operations are time-consuming and costly; also, the durability of such grids depends on the quality of the clamping, the durability of the spacers and the spacing of the rods; what is more, it is very difficult to carry out repairs in situ in the pipe or the short pipe section in which they are mounted.

Any slight loosening is accentuated by relative movement of the elements because of the wear due to friction between the grid components and speeds up the process of deterioration. Stagnant water trapped between the rings and the rods, between the rings and the bars and elsewhere encourages corrosion of the stainless steel.

An alternative proposal is to weld the bars to support bars; this requires a very large number of welds which are very small and vulnerable to corrosion; they generate internal tensions in the metal and reduce the resistance to fatigue caused by vibration; the durability of such grids is limited.

An object of the present invention is to alleviate the above drawbacks.

In arrangements of the kind described in the document FR-A-2 716 530, for example, controlling the solid cleaning elements fundamentally entails, on the one hand, interposing on the outlet pipe of the heat exchanger an interceptor means adapted to retain the solid cleaning elements in question to prevent them being drained out to the sewer with the flow that carries them and, on the other hand, recycling the solid cleaning elements retained in this way by the interceptor means to the inlet pipe of the heat exchanger.

In practice it is also standard practice to pass the solid cleaning elements systematically through a control device adapted in particular to count them, sort them, eliminate those whose dimensions have become smaller than required, because of wear, and supply the system with the necessary new solid cleaning elements.

An object of the present invention is to propose a new interceptor grid that does not have the drawbacks of the prior art and which can be used anywhere in a control installation.

According to the invention, a grid for intercepting solid elements circulated in a heat exchanger to clean it, is characterized in that it includes a frame and molded grid members assembled onto said frame.

Advantageously, the grid members are molded from a synthetic material; the synthetic material is a polypropylene material;

Preferably, the frame is made up of metal chevrons in the form of plates disposed in a parallel arrangement with a regular pitch and transverse spacers and an articulation shaft passing through and welded to the chevrons; the grid members are substantially rectangular and extend successively between two plates.

Advantageously, each grid member has a substantially U-shaped cross section with two flanges and a core, said core is defined by a plurality of longitudinal bars joined by transverse cross members, and the bars and the cross members define a plurality of grid apertures.

Preferably, the flanges have an external longitudinal rim by means of which the grid member rests on the edge of a plates and the transverse distance of the outside faces of the flanges is equal to that between the facing inside faces of two adjacent plates between which the grid member is disposed.

Advantageously, holes in the flanges of the grid members are adapted to be aligned with bores in the plates; grid members placed on respective opposite sides of a plate are assembled thereto by nuts and bolts.

Preferably, positioning devices are provided for precise relative positioning of one grid member relative to another.

Advantageously, the positioning devices include longitudinal tongues at one end of the grid members, placed laterally at the end of the flanges and adapted to cooperate with longitudinal notches placed laterally at the other end of the adjacent grid members.

Independently of or in combination with the above features, the positioning devices include a protrusion and a recess, at one end of a grid member, disposed transversely and respectively adapted to cooperate with a recess and a protrusion disposed transversely at the other end of an adjacent grid member.

The present invention also provides a control installation for solid cleaning elements circulated in a heat exchanger to clean it, the installation including interceptor means adapted to retain and/or guide the solid cleaning elements and the installation being characterized in that the interceptor means include at least one grid as above.

Features and advantages of the invention will emerge from the following description, which is given by way of example and with reference to the accompanying diagrammatic drawings, in which.

Figure 1:
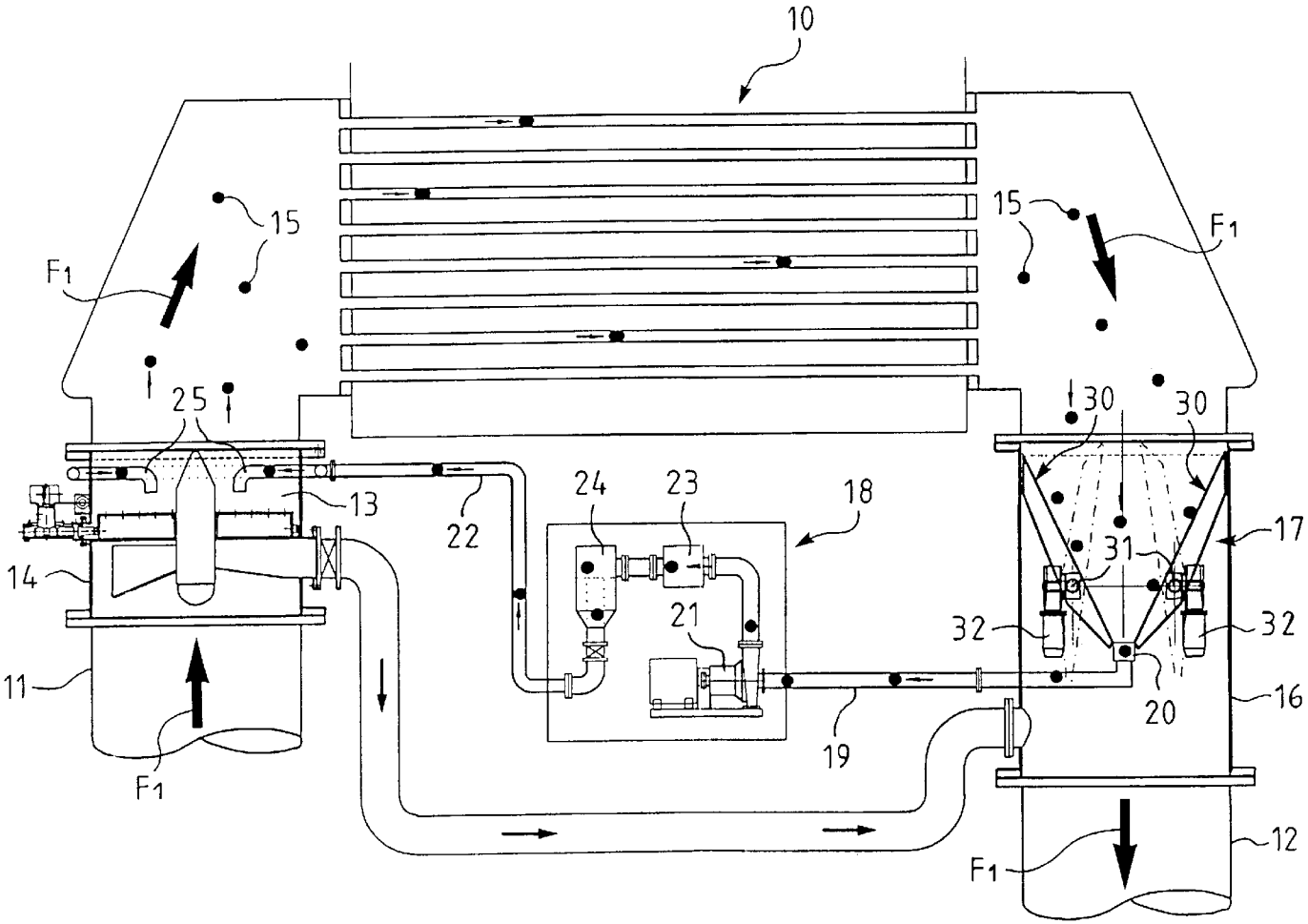
FIG. 1 is a block diagram of a control installation.

FIG. 1 shows diagrammatically a heat exchanger 10, for example a heat exchanger forming a condenser. As symbolized by the arrows F1, a flow of cooling fluid, here water, flows through the heat exchanger via an inlet pipe 11 and an outlet pipe 12.

This kind of heat exchanger 10 is well known in the art and because it is not in itself relevant to the present invention is not described here.

In practice it is a tubular heat exchanger, for example of the type briefly described in the document FRA-2 716 530 mentioned above.

In the embodiment shown, a filter 13 is interposed on the inlet pipe 11 by means of a short pipe section 14.

The filter 13, which is not essential, is not relevant to the present invention either and is not described here either.

It is, for example, a filter of the type described in the document FR-A-2 609 644, for example.

In a manner that is also known in the art, solid cleaning elements 15 can be circulated continuously in the heat exchanger 10 to clean it continuously.

In practice these elements are foam rubber balls whose diameter is slightly greater than that of the tubes of the heat exchanger 10 and whose density, when impregnated, is similar to that of water.

The solid cleaning elements 15 must be controlled, i.e. not only circulated effectively in the heat exchanger 10 but also counted and checked in terms of their dimensions.

In a manner that is known in the art, the solid cleaning elements 15 are systematically injected into the inlet pipe 11 on the downstream side of the filter 13 and entrained by the incoming flow.

In a manner that is also known in the art, an interceptor means 17, adapted to retain the circulating solid cleaning elements 15, are interposed on the outlet pipe 12 by means of a short pipe section 16, and a control installation 18 recycles the solid cleaning elements 15 retained by the interceptor means 17 to the inlet pipe 11.

In a manner that is known in the art, the control installation 18 includes a recycling pipe 19 connected at one end to a recovery facility 20 to which the solid cleaning elements 15 are directed by the interceptor means 17 and at the other end to the suction side of a pump 21 connected to a return pipe 22 via a counter 23 and a collector 24; the return pipe 22 feeds nozzles 25 in the short pipe section 14 which inject into the incoming flow the solid cleaning elements 15 to be put back into circulation therein and which are preferably oriented in a contraflow direction.

Here the interceptor means 17 consists of two grids 30 disposed in a V with the point at the bottom, toward the recovery facility 20 that it surrounds.

Each of the grids 30 is mounted so that it can be rotated about an axis 31 by a gear motor 32 between at least two positions, namely an operational position with the point of the V at the bottom, as shown, and a cleaning position with the point of the V at the top, as indicated in chain-dotted outline, and in which the grids 30 can be cleaned of any unwanted material that they may have retained and that could impede the rolling of the solid cleaning elements 15 along the grids 30.

Figure 2:
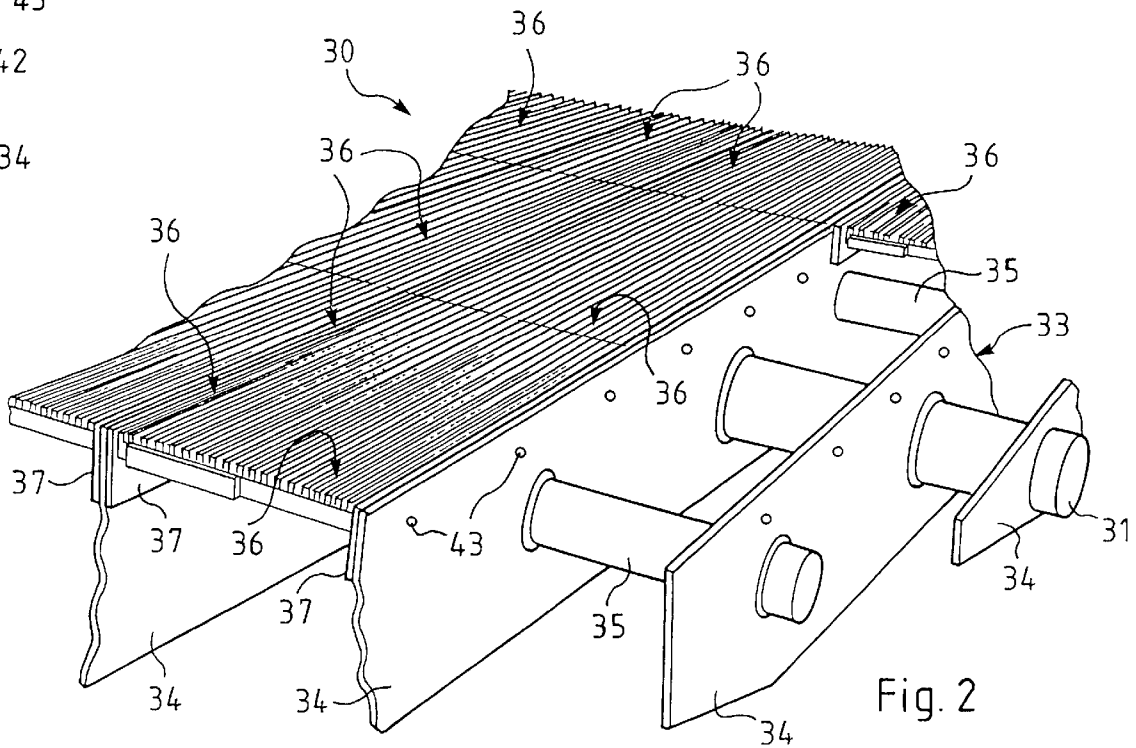
FIG. 2 is a perspective view to a larger scale of part of a grid in accordance with the invention used in the control installation shown in FIG. 1.
Figure 4:
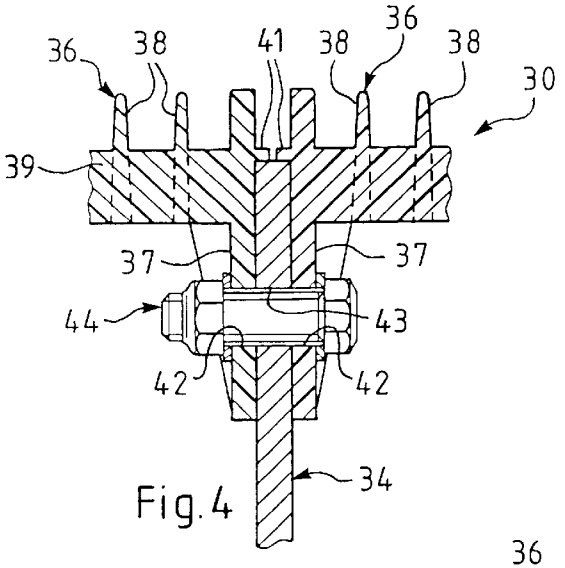
FIG. 4 is a partial view in section showing how two adjacent grid members are fixed to a plate of the frame.
Figure 3:
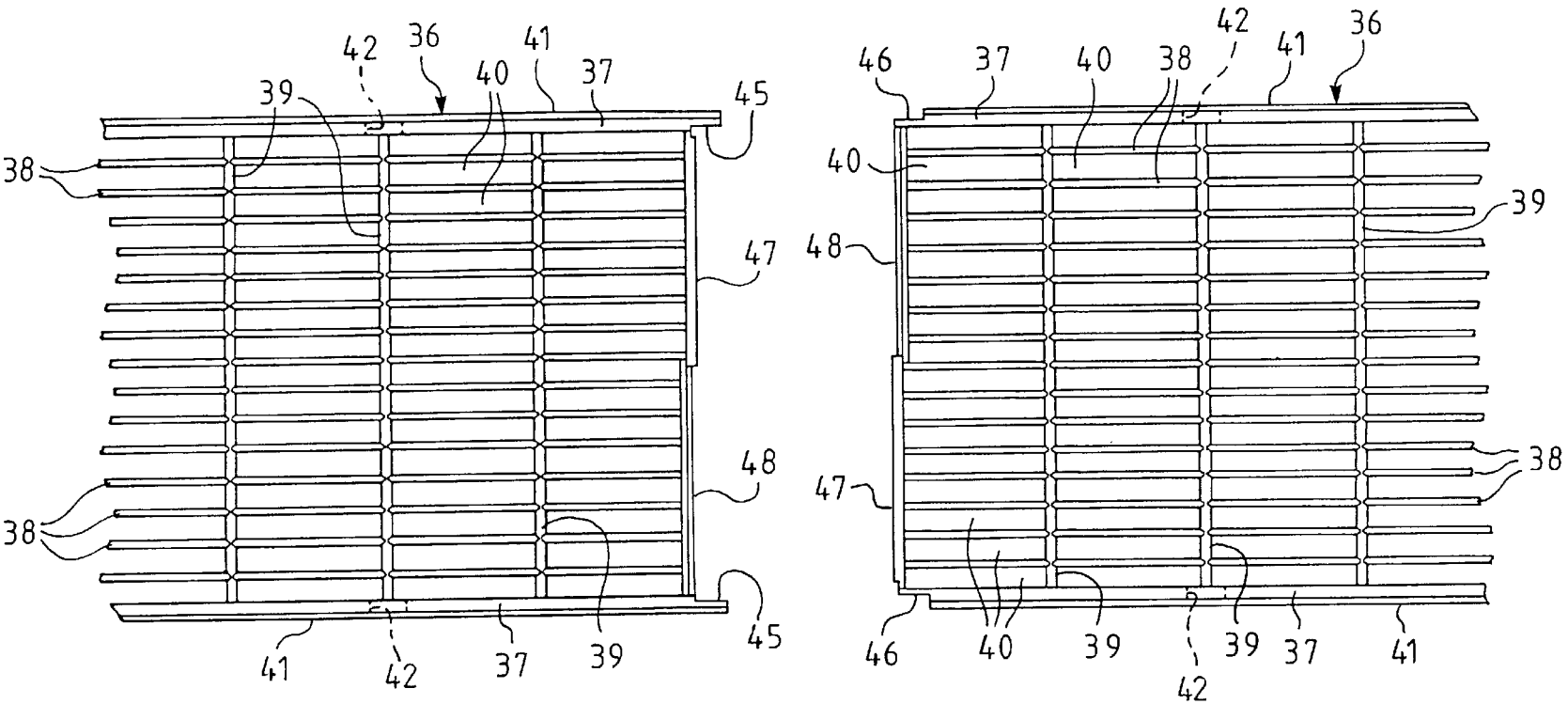
FIG. 3 is a partial view of two contiguous members of the grid shown in FIG. 2.

As can be seen more clearly in FIGS. 2 to 4, a grid 30 includes a frame 33 made up of metal chevrons in the form of plates 34 disposed in a parallel arrangement at a regular pitch. Transverse spacers 35 and the shaft 31 pass through and are welded to the chevrons.

Substantially rectangular grid members 36 are assembled onto the frame 33 and extend successively between two plates 34.

Each grid member 36 is molded, preferably from a synthetic material, for example polypropylene, polyphenylene or some other synthetic material.

A grid member 36 has a substantially U-shaped cross section with two flanges 37; the core of the U is defined by a plurality of longitudinal bars 38 joined by shorter transverse cross members 39, the bars 38 and the cross members 39 defining a plurality of grid apertures 40 which in this example are rectangular.

The flanges 37 have an outside longitudinal rim 41 extending over the whole of the length of the grid member 36 and by means of which the latter rests on the edge of the plate 341 as can be seen in FIG. 4. The transverse distance of the outside faces of the flanges 37 is equal to that between the facing inside faces of two adjacent plates 34 between which the grid member 36 is disposed.

The flanges 37 of the grid members 36 are provided with holes 42 for fixing the grid members 36 to the frame 33, and these holes are advantageously oblong in the longitudinal direction of the grid members 36; the holes 42 are aligned with the bores 43 in the plates 34.

Bolts 44 assemble the grid members 36 on either side of the plate 34 onto it, by means of holes 42 and bores 43 (see FIG. 4).

Positioning devices are provided for precise relative positioning of the grid members 36 relative to each other.

The positioning devices include longitudinal tongues 45 at one end of the grid members 36, placed laterally at the end of the flanges 37 and adapted to cooperate with longitudinal notches 46 placed laterally at the other end of the grid member 36.

Here, the positioning devices further include a protrusion 47 and a recess 48 between the longitudinal tongues 45, disposed transversely and respectively adapted to cooperate with a recess 48 and a protrusion 47 disposed transversely between the longitudinal notches 46.

Because the grid members 36 are molded, they can be made with great accuracy and optimized to reduce head losses and turbulence, which minimizes vibration; the grid according to the invention is insensitive to corrosion, easy to assemble and light in weight; its unit cost is not high and it can be changed easily, one member at a time.

Clearly, a grid according to the invention can be used anywhere in any control installation, including an installation of the kind described in the document FR-A-2 766 915.

What is claimed is:

1. A grid for intercepting solid elements circulated in a heat exchanger to clean it, said grid including a frame and molded grid members assembled onto said frame which is made up of metal chevrons in the form of plates disposed in a parallel arrangement with a regular pitch and transverse spacers and an articulation shaft passing through and welded to the chevrons, the grid members being globally rectangular and extend successively between two plates, each grid member having a globally U-shaped cross section with two flanges and a core, said core being defined by a plurality of longitudinal bars joined by shorter transverse cross members, and the bars and the cross members defining a plurality of grid apertures;

characterized in that the flanges of the grid members are provided with holes adapted to be aligned with bores in the plates.

2. A grid according to claim 1, characterized in that the grid members are molded from a synthetic material.

3. A grid according to claim 2, characterized in that the synthetic material is polypropylene.

4. A grid according to claim 3, characterized in that the synthetic material is a polyphenylene material.

5. A grid according to claim 1, characterized in that the flanges have an external longitudinal rim by means of which the grid member rests on the edge of a plate, a transverse distance between outside faces of the flanges corresponding to a distance between opposing faces of two adjacent plates between which the grid member is disposed.

6. A grid according to claim 1, characterized in that grid members placed on respective opposite sides of a plate are assembled thereto by bolts.

7. A grid according to claim 1, characterized in that positioning devices are provided for precise relative positioning of one grid member relative to another.

8. A grid according to claim 1, characterized in that the positioning devices include longitudinal tongues at one end of the grid members, placed laterally at the end of the flanges and adapted to cooperate with longitudinal notches placed laterally at the other end of the adjacent grid member.

9. A grid according to claim 7, characterized in that the positioning devices include a protrusion and a recess, at one end of a grid member, disposed transversely and adapted to cooperate respectively with a recess and a protrusion disposed transversely at the other end of an adjacent grid member.

10. A control installation for solid cleaning elements circulated in a heat exchanger to clean it, of the kind including an interceptor means adapted to retain and/or guide the solid cleaning elements characterized in that the interceptor means include at least one grid according to claim 1.

* * * * *